US010663189B2

(12) United States Patent
Zlobinsky et al.

(10) Patent No.: US 10,663,189 B2
(45) Date of Patent: May 26, 2020

(54) ENVIRONMENTAL ROOM WITH REDUCED ENERGY CONSUMPTION

(71) Applicant: Harris Environmental Systems, Inc., Andover, MA (US)

(72) Inventors: Yury Zlobinsky, Meadowbrook, PA (US); Yury Langer, Auburn, NH (US)

(73) Assignee: Harris Environmental Systems, Inc., Andover, MA (US)

( * ) Notice: Subject to any disclaimer, the term of this patent is extended or adjusted under 35 U.S.C. 154(b) by 405 days.

(21) Appl. No.: 15/356,551

(22) Filed: Nov. 19, 2016

(65) Prior Publication Data

US 2018/0142912 A1 May 24, 2018

(51) Int. Cl.

| | |
|---|---|
| ***F24F 11/81*** | (2018.01) |
| ***F24F 13/04*** | (2006.01) |
| ***F24F 11/30*** | (2018.01) |
| *F24F 110/20* | (2018.01) |
| *F24F 140/60* | (2018.01) |
| *F24F 110/10* | (2018.01) |

(52) U.S. Cl.

CPC ..... *F24F 11/81* (2018.01); *F24F 11/30* (2018.01); *F24F 13/04* (2013.01); *F24F 2110/10* (2018.01); *F24F 2110/20* (2018.01); *F24F 2140/60* (2018.01)

(58) Field of Classification Search

CPC .. F24F 11/81; F24F 13/04; F24F 13/06; F24F 2110/10; F24F 2110/20

See application file for complete search history.

(56) References Cited

U.S. PATENT DOCUMENTS

| | | | | |
|---|---|---|---|---|
| 2,767,961 A * | 10/1956 | Frankland | F24F 3/044 165/49 |
| 3,143,952 A * | 8/1964 | Simons | F24F 9/00 454/190 |
| 3,376,916 A | 4/1968 | Gressett | |
| 3,415,073 A * | 12/1968 | Ammons | F24F 13/20 62/259.1 |
| 3,625,022 A * | 12/1971 | Johnson | F24F 3/044 62/159 |
| 3,720,258 A | 3/1973 | Chandler | |
| 3,738,572 A * | 6/1973 | Hall, Jr. | F24F 3/048 236/49.4 |

(Continued)

*Primary Examiner* — Nelson J Nieves

(74) *Attorney, Agent, or Firm* — Sheehan Phinney Bass & Green PA

(57) ABSTRACT

An environmental room for controlling temperature and/or humidity levels at very close uniformity control levels, and at reduced energy requirements. Air flow of the system is divided such that only a portion of total air flow for the room is passed through the temperature and/or humidity air conditioning components, while the remainder of the air flow remains untreated. The treated and untreated air flow is then homogeneously mixed to obtain air having the required temperature and/or humidity levels. By passing only a portion of total air flow through the temperature and/or humidity control components, the required size and capacity of these components can be reduced, and energy requirements and costs for the environmental room can also be reduced. In addition, previously unattainable tolerance and uniformity levels are achieved.

16 Claims, 8 Drawing Sheets

(56) References Cited

U.S. PATENT DOCUMENTS 3,779,150 A * 12/1973 Sproul, Sr. ..... F24F 13/072 454/301
3,835,758 A * 9/1974 Bean ..... F24F 3/044 454/236
3,853,173 A * 12/1974 Osheroff ..... F15C 1/008 165/213
3,883,071 A * 5/1975 Meckler ..... F24F 13/04 236/13
3,900,301 A * 8/1975 Constantinescu ..... F24F 3/14 165/124
3,901,275 A * 8/1975 Logsdon ..... F16K 11/052 137/599.03
3,980,127 A 9/1976 Sacks
3,988,900 A * 11/1976 Kamata ..... F24F 1/00 62/92
4,013,217 A * 3/1977 Owen ..... F24F 3/056 137/889
4,258,615 A * 3/1981 Vivian ..... F24D 5/00 165/249
4,495,113 A * 1/1985 Kice ..... F24F 6/14 261/117
4,562,883 A * 1/1986 Janeke ..... F24D 11/006 165/57
4,616,557 A * 10/1986 Paoluccio ..... F24F 7/007 454/230
4,784,212 A * 11/1988 Brimer ..... G05D 23/1917 165/240
4,902,322 A * 2/1990 Grinblat ..... F24F 3/00 165/205
5,003,867 A * 4/1991 Sodec ..... F24F 3/044 454/236
5,368,521 A * 11/1994 Koenig ..... F24F 13/04 454/261
5,513,953 A * 5/1996 Hansen ..... F04D 25/088 415/183
6,019,677 A * 2/2000 Demster ..... F24F 7/10 454/289
6,168,517 B1 * 1/2001 Cook ..... F24F 7/007 454/269
6,572,468 B1 * 6/2003 Sasaki ..... F24F 3/161 454/187
6,789,618 B2 9/2004 Pearson
6,986,708 B2 * 1/2006 Demster ..... E04B 9/02 454/248
7,251,953 B2 8/2007 Wetzel et al.
7,635,296 B2 12/2009 Gagnon et al.
7,802,443 B2 9/2010 Wetzel
8,052,062 B2 11/2011 Stark
8,151,578 B1 4/2012 Morales et al.
8,578,727 B2 11/2013 Tsutsumi
8,651,391 B2 2/2014 Patch
9,121,618 B2 9/2015 Fisher et al.
2001/0049927 A1 * 12/2001 Toepel ..... B01D 46/0002 55/385.2
2002/0174608 A1 11/2002 Rapisarda et al.
2003/0000230 A1 * 1/2003 Kopko ..... F24F 3/00 62/82
2004/0177629 A1 9/2004 Eoga
2004/0185771 A1 9/2004 Hopkins
2005/0028970 A1 2/2005 Sekhar et al.
2005/0132677 A1 * 6/2005 Bauer ..... F24F 3/161 55/385.2
2006/0021375 A1 2/2006 Wetzel et al.
2006/0196199 A1 9/2006 Hunt, Jr.
2007/0023536 A1 2/2007 Baston
2007/0037507 A1 2/2007 Liu
2007/0039343 A1 2/2007 Ikegami et al.
2008/0194195 A1 8/2008 Duke
2008/0214099 A1 * 9/2008 Veuillet ..... F24F 13/06 454/233
2008/0250800 A1 10/2008 Wetzel
2009/0186572 A1 * 7/2009 Farrell ..... F24F 13/06 454/256
2013/0040549 A1 * 2/2013 Douglas ..... F24F 13/1413 454/239
2014/0033751 A1 * 2/2014 Bailey ..... F24F 13/14 62/178
2014/0326428 A1 * 11/2014 Meirav ..... F24F 3/1603 165/11.1
2016/0085248 A1 3/2016 Gordon et al.
2017/0010017 A1 * 1/2017 Fiegen ..... F24F 13/04
2017/0307242 A1 * 10/2017 Handsaker ..... F24F 11/89
2018/0080696 A1 * 3/2018 Luchner ..... F25B 49/022
2018/0180304 A1 * 6/2018 Olsen ..... F24F 13/222
2018/0274802 A1 * 9/2018 Nishimura ..... F24F 3/14

* cited by examiner

ENVIRONMENTAL ROOM WITH REDUCED ENERGY CONSUMPTION

FIELD OF THE INVENTION

The present invention generally relates to an environmental room, and more particularly to an environmental room designed to control temperature and/or humidity levels at very close tolerance and uniformity levels.

BACKGROUND

Environmental rooms, which are essentially enclosures designed to provide carefully controlled conditions therein, are useful in a variety of applications. For example, environmental rooms may find use in biological, medical, and pharmaceutical applications, as well as industrial and consumer product testing and development, electronics, aeronautics and aerospace applications, automotive applications, archival storage, materials testing, entomology, crop and soil science and plant growth, control for human performance test labs, film testing and development, and stability/shelf-life testing.

Typically, an environmental room is designed to provide continually controlled conditions, particularly temperature and/or humidity levels. If desired, other variables such as levels of contamination and pressure may be controlled. In such environmental rooms, it is usually desirable to provide very uniform air temperature at working surfaces as well as throughout the entire room, with a high degree of accuracy (referred to as tolerance). Uniformity generally refers to the temperature distribution, and may refer to the deviation from a specified temperature maintained across the room at working height. With environmental rooms, there are two typical temperature uniformity specifications: ±1.0° C. or ±0.5° C. A desired uniformity of 21° C.±0.5° C. would mean that the temperature at one end of the working surface can be 20.5° C., but no other point at the working height can exceed 21.5° C., even when all the specified temperature and moisture loads are active in the space at the same time. A typical relative humidity uniformity level may, for example, be on the order of ±5%.

In addition to uniformity, gradient is also important. In an environmental room, the gradient generally refers to the maximum temperature difference between any two points in the room. For example, in the 21° C. room temperature with a uniformity of ±0.5° C., a maximum gradient may be 1.0° C. In order to achieve a particular gradient, it is important to circulate air to evenly distribute and remove heat within the room.

In certain applications, an environmental room is in the form of a test chamber designed to provide variations in one or more conditions therein to determine how the contents of the enclosure react; for example, through exposure to extreme temperatures, thermal cycling, and/or extreme humidity. Such test chambers, thus, must be designed to provide a particular set of conditions within the chamber and must be able to vary one or more of those conditions within the chamber on demand.

Generally, an environmental room is provided as a stand-alone room within an existing building. For example, as depicted in FIGS. 1A-B, a conventional environmental room 10 may be provided with an overall outer housing structure 11, and provided within the housing structure is a floor, ceiling, inner walls 12, room dividers 14, ceiling plenum(s) disposed between the ceiling and upper surface of the outer housing structure 11, and wall plenum(s) 18 disposed between the inner walls 12 and one or more side surfaces of the outer housing structure 11. A control panel 20 is typically provided at a convenient location in the outer housing structure 11, such as near an entry/exit door 22.

As shown in the top cutaway view in FIG. 1B, which illustrates inside the ceiling plenum space, equipment is disposed therein for maintaining the desired temperature and humidity performance levels within the room. A conventional arrangement is depicted for an environmental room 10 that is divided into a smaller room 24 and a larger room 26. As shown, the smaller room 24 and the larger room 26 each have their own ceiling plenum space, each with their own air treatment equipment located therein. For example, in the ceiling plenum for the smaller room 24, a latent coil 25, an evaporator coil 28, a heater assembly 30, and a humidifier 32 are arranged in series so that air circulated through the ceiling plenum passes through the latent coil 25, evaporator coil 28, heater 30, and humidifier 32, and is then directed into the smaller room 24 below. As further shown, in order to accommodate the larger air flow through the larger room 26 and to maintain the temperature and humidity requirements in that room, two air treatment setups (i.e., evaporator coil 28, heater 30, and humidifier 32) may be provided in the plenum space above the larger room 26.

The ceiling plenum(s) may further house light fixtures 34 to provide adequate lighting to the room below. In some cases, one or more return air wall plenums 36 are provided for directing air from the floor area of the room and to the ceiling plenum area for proper temperature and humidity control.

Conventionally, when designing an environmental room, one generally begins with a determination of the necessary air flow for the entire room. Based on the air flow need, one then selects the appropriate evaporator and condenser units. As such, the size of the overall system needed to control the temperature and humidity levels is based, ultimately, on the total quantity of air flow. In addition, the system is typically designed based on a schematic in which the latent coil, evaporator, condenser, fans, heater, humidifier, etc. are all positioned on one side of a room's ceiling plenum space (e.g., as depicted in FIG. 1B), and the entire air flow is pumped through the system and into the room. Such a system design typically necessitates larger components that utilize a significant amount of energy to run as needed to maintain the very close tolerance and uniformity control levels. Further, while it is often desirable to provide large environmental rooms (thus, greater capacity) with very close tolerance and uniformity levels, construction costs and subsequent operation costs become more expensive with increased complexity and room capacity. In particular, the costs of such rooms generally increase as the size of the mechanical system increases, and as the room architecture to accommodate air distribution plenums and ductwork becomes more complicated.

It would be desirable to provide improvements to such environmental room designs. In particular, it would be desirable to provide improved environmental rooms that are capable of controlling temperature and humidity levels at very close tolerance and uniformity control levels, but with reduced energy consumption during operations and lower overall upfront costs.

SUMMARY OF THE INVENTION

Embodiments of the present invention provide an environmental room configured to control temperature and/or humidity levels at very close tolerance and uniformity levels. In particular, according to embodiments of the present invention, air flow of the system is divided, and only a portion of total air flow (also referred to herein as "treated air flow") for the room is passed through air conditioning components. As referred to herein, "air conditioning components" include the various components/equipment provided to modify one or more properties of the air flow, particularly temperature and/or humidity. One or more fans are provided and arranged so as to mix the portion of air flow that has passed through the air conditioning components with the remainder portion of air flow (wherein the remainder portion of air flow is also referred to herein as "untreated air flow") that does not pass through the air conditioning components, and provide a homogenous mixture that is then distributed to the environmental room.

By providing an environmental room design in which only a portion of total air flow is passed through the air conditioning components, the required size and capacity of these components can be reduced. This results in lower upfront component costs as well as lower ongoing operating costs by reducing overall energy consumption. Further, such an environmental room design makes it possible to achieve tolerance and uniformity control that is far superior to those provided by currently available environmental room designs. In particular, while current environmental rooms may achieve temperature uniformity of ±1.0° C., or at best ±0.5° C., the present invention environmental rooms are capable of achieving temperature uniformity of ±0.3° C. or better (where "better" refers to lower than ±0.3° C., potentially reaching down to ±0° C.). Further, while current environmental rooms may achieve humidity uniformity on the order of ±5%, the present invention environmental rooms are capable of achieving humidity uniformity of ±3% or better (where "better" refers to lower than ±3%).

According to one aspect, the present invention provides an environmental room comprising an outer housing having a top surface, a bottom surface, and side surfaces; a floor, ceiling, and walls disposed within the outer housing to define an environmental room chamber, the environmental room chamber being provided with a required temperature level and a required humidity level; a ceiling plenum disposed between the ceiling and the top surface of the outer housing; the ceiling plenum divided into at least one conditioning section and at least one distribution section; air conditioning components disposed within the conditioning section, the air conditioning components being configured for modifying temperature and/or humidity of supplied air; and one or more fans disposed in communication with the conditioning section and the distribution section. The environmental room is configured such that air flow from the environmental room chamber is circulated from the environmental room chamber into the conditioning section of the ceiling plenum, and is then divided so that a only a portion of the air flow through the conditioning section is directed through the air conditioning components, and a remainder of the air flow does not pass through the air conditioning components. The portion of air flow directed through the air conditioning components forms treated air, and the remainder of the air flow forms untreated air. The treated air and the untreated air is directed through the one or more fans to form a homogeneous mixture of air having the required temperature level and the required humidity level.

Embodiments according to this aspect can further include one or more of the following features. The air conditioning components can comprise at least one latent heat coil and/or desiccant drier, at least one evaporator, at least one heating assembly, and at least one humidifier. Dividing the ceiling plenum into at least one conditioning section and at least one distribution section, and passing only a portion of the air flow through the air conditioning components, provides a reduction in size, capacity, and/or number of air conditioning components for modifying temperature and/or humidity of air as compared with the size, capacity, and/or number of air conditioning components if the entire air flow was passed through the air conditioning components. The environmental room can further include a control panel for setting the required temperature level and the required humidity level in the environmental room chamber, the control panel being in communication with one or more temperature and humidity sensors disposed in the environmental room chamber and/or in the ceiling plenum. The environmental room can be configured such that about 20% to about 50% of the total air flow can be directed through the air conditioning components. The homogeneous mixture of air is provided with a temperature uniformity of ±0.3° C. or better. The homogeneous mixture of air is provided with a humidity uniformity of ±3% or better.

According to another aspect, the present invention provides a method for fabricating an environmental room having reduced energy requirements comprising: forming an outer housing having a top surface, a bottom surface, and side surfaces; forming a floor, ceiling, and walls within the outer housing to define an environmental room chamber, the environmental room chamber being provided with a required temperature level and a required humidity level; forming a ceiling plenum between the ceiling and the top surface of the outer housing; dividing the ceiling plenum into at least one conditioning section and at least one distribution section; disposing air conditioning components for modifying temperature and/or humidity of air within the conditioning section; disposing one or more fans in communication with the conditioning section and the distribution section; providing air flow passages from the environmental room chamber for circulation from the environmental room chamber into the ceiling plenum where the air flow is provided to the conditioning section and is divided so that a portion of the air flow is directed through the air conditioning components, and a remainder of the air flow is directed through the conditioning section without passing through the air conditioning components. In particular, the portion of air flow directed through the air conditioning components forms treated air, and the remainder of the air flow forms untreated air, where the treated air and the untreated air is directed through the one or more fans to form a homogeneous mixture of air having the required temperature level and the required humidity level.

Embodiments according to this aspect can further include one or more of the following features. The air conditioning components can comprise at least one latent heat coil and/or desiccant drier, at least one evaporator, at least one heating assembly, and at least one humidifier. Dividing the ceiling plenum into at least one conditioning section and at least one distribution section, and passing only a portion of the air flow through the air conditioning components reduces a size, capacity, and/or number of air conditioning components for modifying temperature and/or humidity of air as compared with the size, capacity, and/or number of air conditioning components if the entire air flow was passed through the air conditioning components. The method further comprises disposing a control panel for setting the required temperature level and the required humidity level in the environmental room chamber, the control panel being in communication with one or more temperature and humidity sensors disposed in the environmental room chamber and/or in the ceiling plenum. About 20% to about 50% of the total air flow is directed through the air conditioning components. The homogeneous mixture of air is provided with a temperature uniformity of ±0.3° C. or better. The homogeneous mixture of air is provided with a humidity uniformity of ±3% or better.

According to another aspect, the present invention provides a method for reducing the energy requirement of an environmental room, comprising: forming a ceiling plenum within the environmental room, the ceiling plenum being divided into at least one conditioning section and at least one distribution section; disposing air conditioning components for modifying temperature and/or humidity of air within the conditioning section to produce treated air having a modified temperature and/or humidity; circulating air flow from an environmental room chamber to the ceiling plenum, the environmental room chamber having a predetermined required temperature level and required humidity level; directing only a portion of the air flow less than 100% through the air conditioning components in the conditioning section, and directing a remainder of the air flow to the conditioning section but not through the air conditioning components; modifying the temperature and/or humidity of the portion of air flow directed to the conditioning section to produce treated air; and mixing the treated air with remainder of the air flow to provide a homogeneous mixture of air having the required temperature level and the required humidity level.

Embodiments according to this aspect can further include one or more of the following features. About 20% to about 50% of the total air flow is directed to the air conditioning components. The homogeneous mixture of air is provided with a temperature uniformity of ±0.3° C. or better. The homogeneous mixture of air is provided with a humidity uniformity of ±3% or better.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The components in the drawings are not necessarily to scale, emphasis instead being placed upon clearly illustrating the principles of the present invention. The drawings illustrate embodiments of the invention and, together with the description, serve to explain the principals of the invention.

DETAILED DESCRIPTION

Figure 1A:
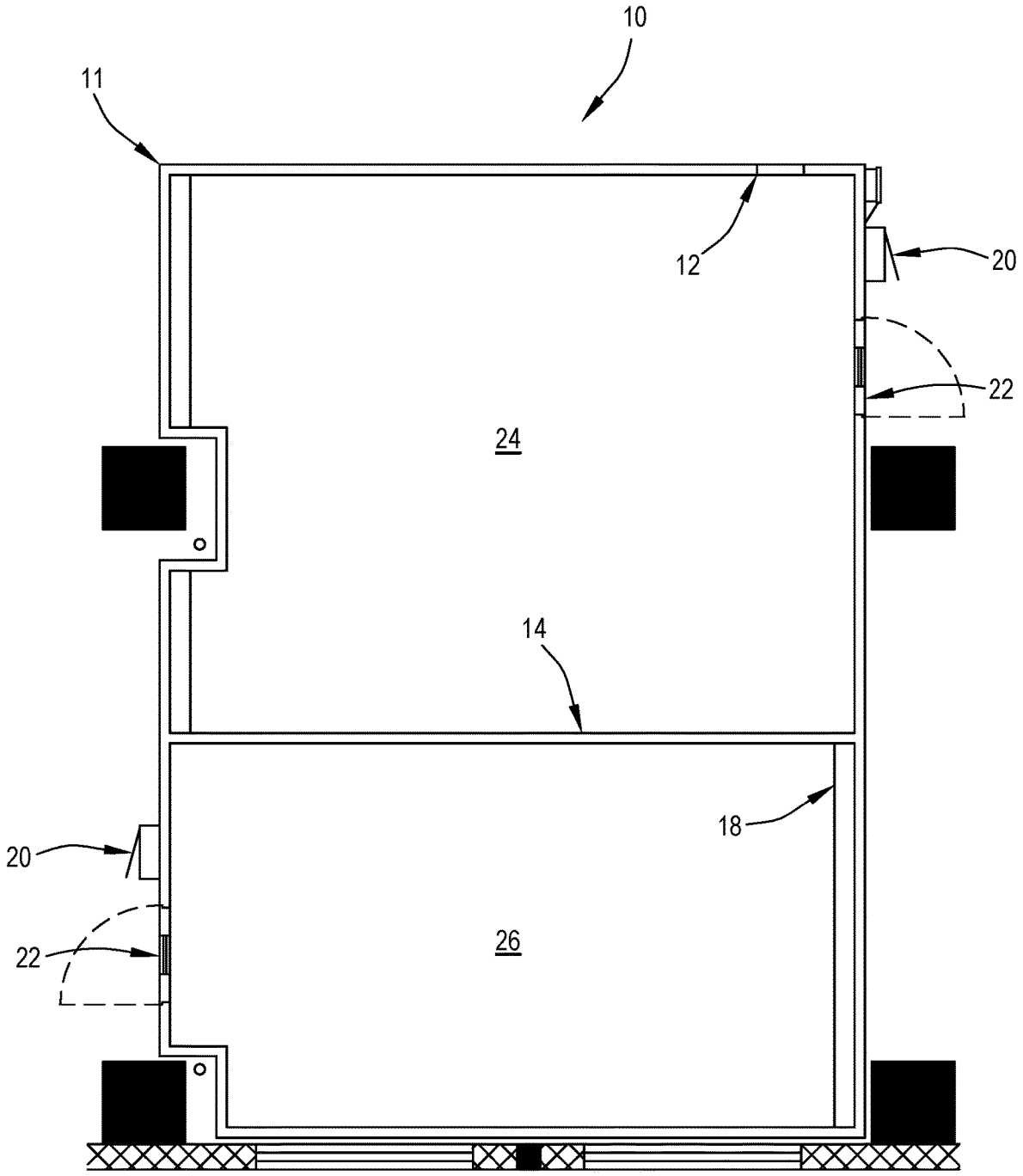
FIGS. 1A-B schematically illustrate a conventional environmental room, with FIG. 1A showing the general layout of the environmental room, and FIG. 1B showing a top cross-sectional view within the ceiling plenum space.
Figure 1B:
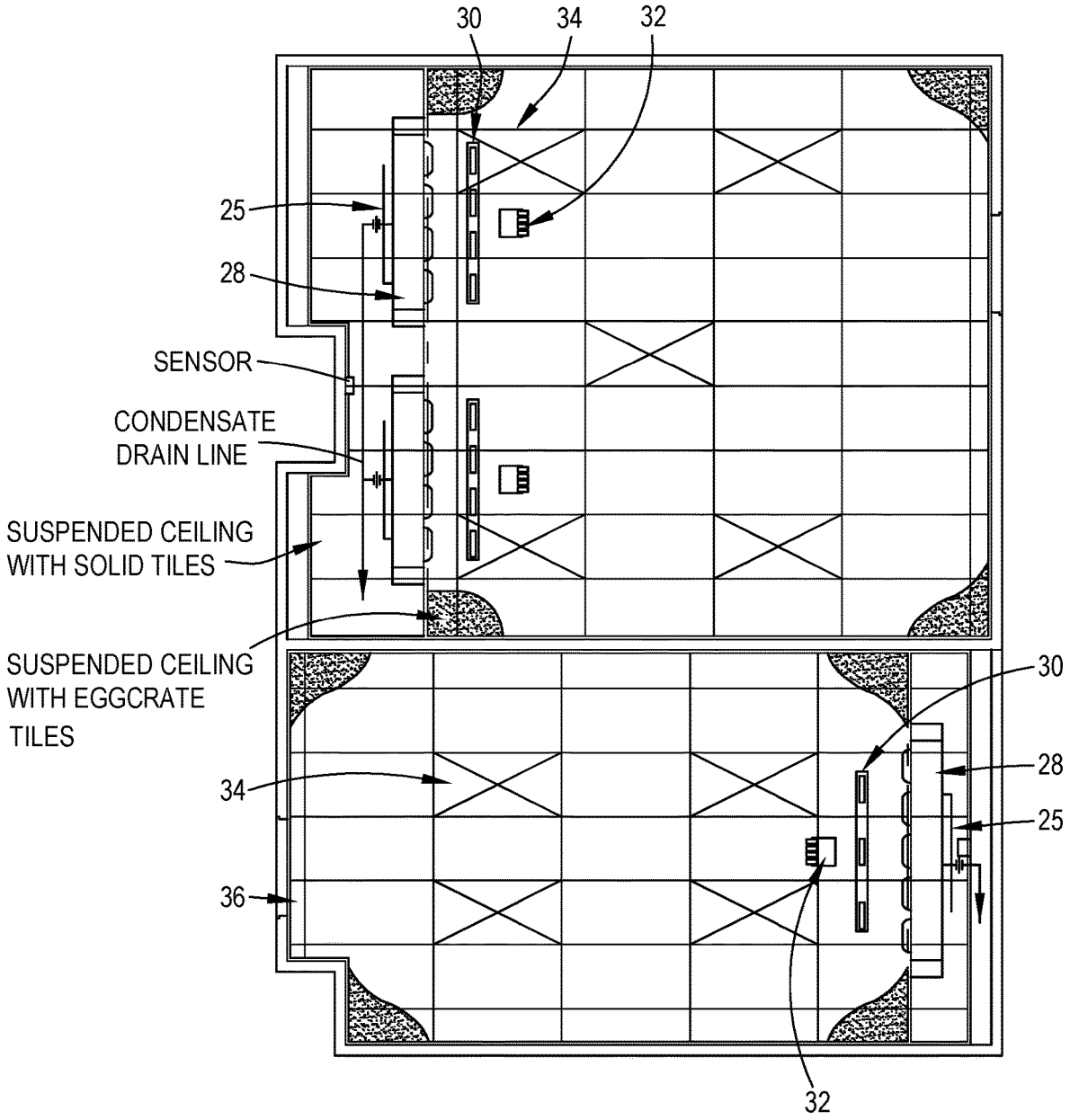

The present invention generally provides improved environmental rooms that are capable of achieving previously unattainable levels of uniformity and tolerance levels, particularly with respect to temperature and humidity control. In particular, the present invention provides an environmental room in which a plenum space is divided into a conditioning section and one or more distribution sections. According to embodiments of the invention, only a portion of the air flow in the system passes through air conditioning components in the conditioning section. By reducing the total air flow passing through the air conditioning components, these various air conditioning components can be reduced in size, thus reducing construction costs. In addition, energy consumption is reduced due to the decrease in treated air flow.

The general structure of the present environmental room can be in accordance with the general structure of conventional environmental rooms. In particular, the environmental room is typically constructed as a stand-alone room for placement in an existing building. As such, it is designed to have its own floor, ceiling and walls. The size of the room may vary widely depending on ultimate use, and the room can be formed as a single compartment or may be divided into multiple compartments, if desired. Access may be provided through one or more doors of varying sizes to allow for entry of people, as well as the various equipment that may enter and/or exit the room.

Reference will now be made in detail to embodiments of the present invention, examples of which are illustrated in the accompanying drawings. Wherever possible, the same reference numbers are used in the drawings and the description to refer to the same or like parts.

FIGS. 2A-D show various views of an embodiment of an environmental room according to the present invention. As shown, the environmental room 100 is generally defined by an outer housing 102. Within the outer housing 102, a floor 104, a ceiling 106, and return air walls 110 are provided defining the interior of the environmental room 100.

The outer housing 102 can be fabricated of any conventional materials used on forming environmental rooms, for example, insulated walls fabricated of a cladding material (e.g., various metals such as galvanized steel and aluminum, plastic, etc.) in combination with an insulating material (e.g., foamed-in-place isocyanurate insulation). Disposed within the outer housing 102 are the necessary integral parts for operating the environmental room and equipment therein such as, for example, refrigeration piping, electrical wiring, control wiring, and various connectors. Electrical feeds for the equipment and control panel are further suitable disposed therein to thus provide a complete self-contained unit and system, with all essential plenums, controls, balanced air circulation and all other equipment necessary to reach the specified environmental conditions.

The floor 104 is in accordance with any conventional environmental room floor designs. In some embodiments, the floor 104 is preferably constructed to be about 3"-4" thick, and is fabricated of any conventional materials. In an exemplary embodiment, the floor is insulated and is formed of a combination of top and bottom layers of cladding (e.g., galvanized steel, aluminum, plastic, etc.) sandwiching a layer of insulation. The walls and ceiling are preferably constructed using about 3"-4" thick rectangular wall panels.

The panels may be constructed in accordance with any conventional panel designs. If desired, one or more hermetically sealed observation windows may be provided in one or more walls.

In the illustrated embodiment, the environmental room 100 includes three separate chambers 101, 103, 105 separated by dividers 107, with each chamber 101, 103, 105, having its own entry door(s) 109. It is noted that while the present invention depicts three separate chambers, the present invention is not limited as such, and could be provided with a single chamber, or any other desired number of chambers.

A control panel 111 is provided for each chamber 101, 103, 105 at any convenient location along the outer housing 102, such as near one or more entry/exit doors 109. The control panel 111 is configured and designed to allow a user to set, modify, monitor, etc. the various conditions (e.g., temperature, humidity, etc.) within the chambers 101, 103, 105. By having a plurality of chambers 101, 103, 105, each with its own control panel 111, one can beneficially set each of the chambers' 101, 103, 105 conditions independently, so as to provide the same or different conditions in any of the chambers 101, 103, 105 as needed.

According to embodiments of the present invention, the control panel 111 includes a temperature control unit that may generally be in accordance with any conventional temperature control unit and, for example, may be microprocessor based. The temperature control unit is configured to continuously monitor room conditions (through communication with one or more sensors (see. e.g., 132 in FIG. 2A) disposed within the room and/or ceiling plenum) versus the set temperature specifications, and can provide an output which will modify the treatment equipment (particularly the conditioning system) capacity in response to any deviation from the set temperature specification. The sensor(s) may be provided for rapid response to temperature fluctuation. The control panel 111 further includes a relative humidity control unit, which may generally be in accordance with any conventional humidity control unit and, for example, may be microprocessor based. The relative humidity control unit is configured to continuously monitor room humidity conditions (through communication with one or more sensors disposed within the room and/or ceiling plenum) versus the set humidity specification, and can provide an output which will modify the treatment equipment (particularly the conditioning system) capacity in response to any deviation from the set humidity specification. The sensors may be provided for rapid response to humidity fluctuation. An alarm and safety control system may further be provided, which monitors for high and low temperature and/or humidity set points, thus triggering the alarm sound and, if appropriate, shutting down heat producing devices (for a high temperature alarm set point), or shutting down cold producing devices (for a low temperature alarm set point) if the conditions within the environmental room deviate above or below the high and low set points.

Figure 2A:
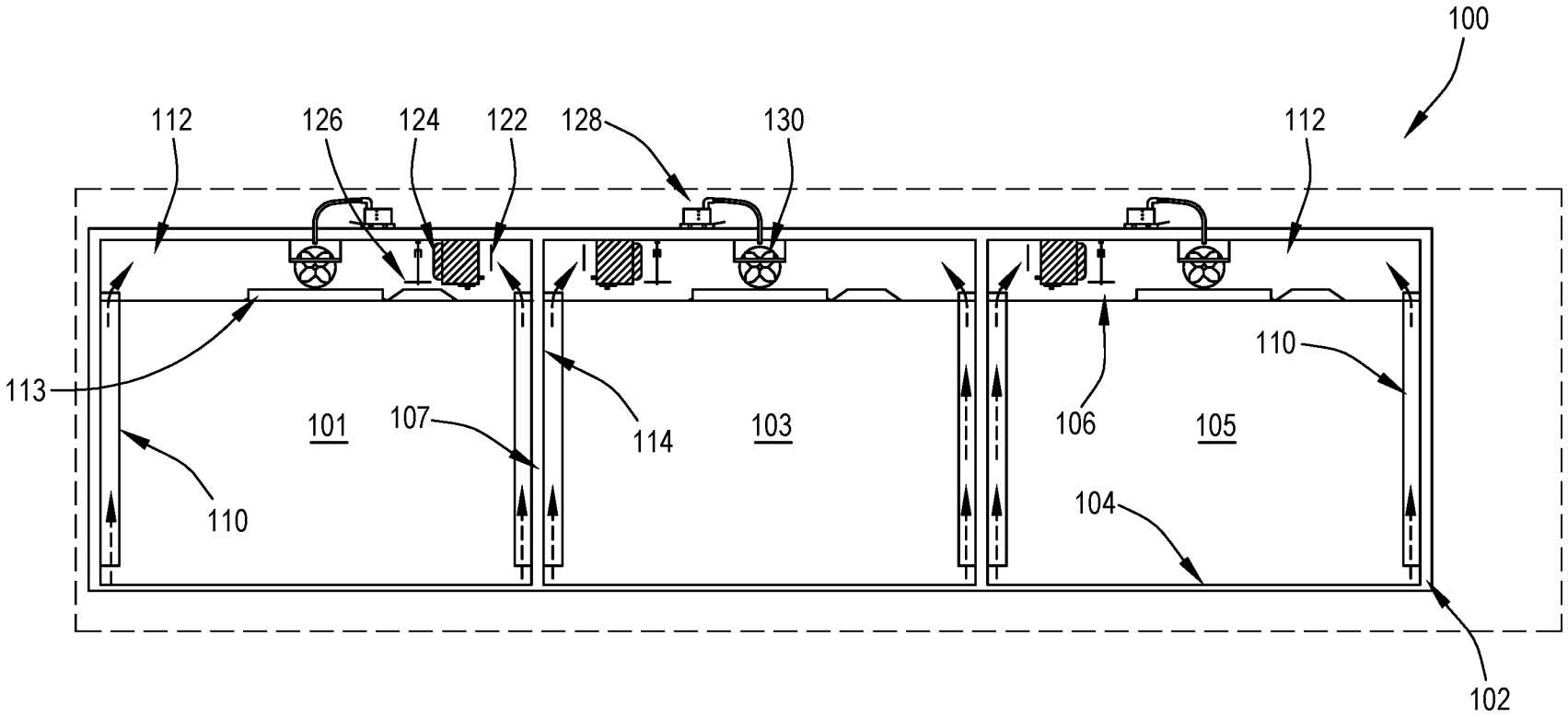
FIGS. 2A-D schematically illustrate an environmental room according to an embodiment of the present invention, with FIG. 2A showing a side cross-sectional view, FIG. 2B showing a side exterior view, FIG. 2C showing a top cross-sectional view within the ceiling plenum space, and FIG. 2D showing a general layout of the environmental room.
Figure 2B:
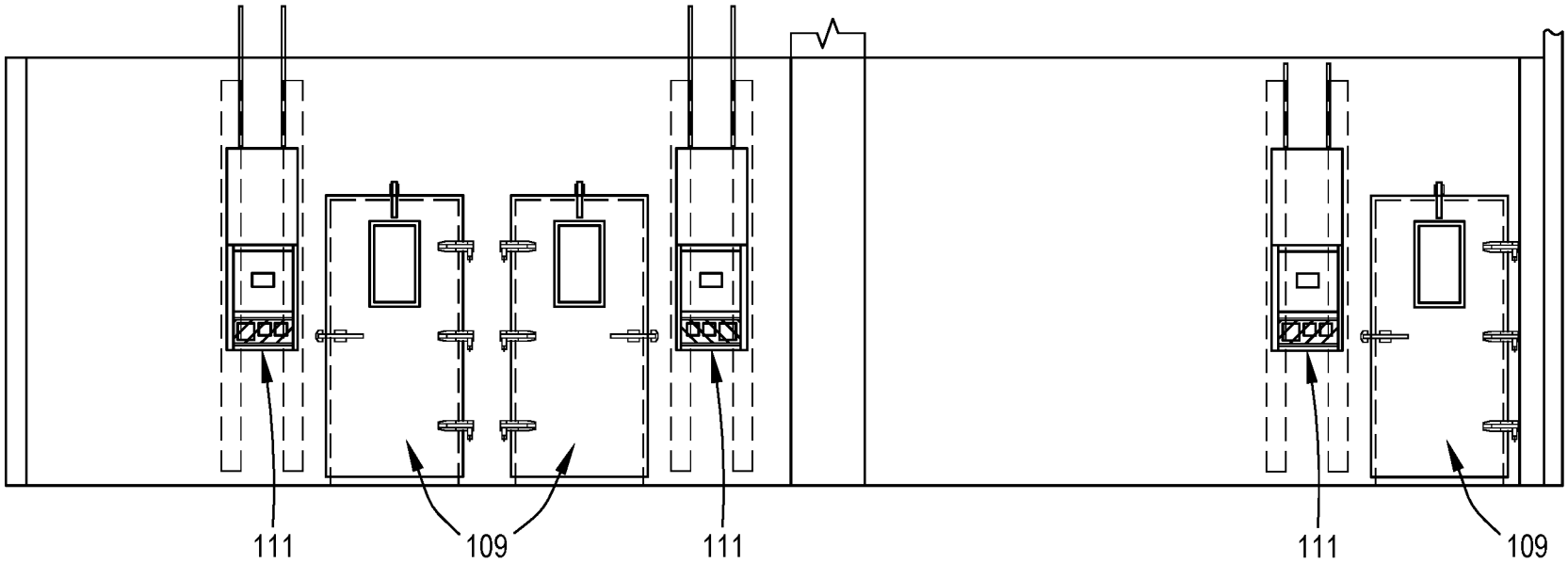

FIG. 2A includes a schematic representation of a sensor 132 disposed within one of the rooms 101 and a sensor 132 within the ceiling plenum for that room 101. Various implementations may include both of those sensors, or any one of those sensors without the other. This schematic representation should not be interpreted as disclosing any information about the location of these sensors 132 other than that they are located within the room 101 and within the ceiling plenum for that room 101.

The environmental room 100 is designed with a particular inner ceiling 106 height (e.g., 7-8 ft. above the finished floor 104) above which a ceiling plenum 112 (typically about 1-2 ft. in height above the inner ceiling 106) is disposed. The ceiling plenum 112 provides air circulation and distribution for the environmental room, and houses much of the equipment required for maintaining the desired temperature and humidity performance levels within the chamber below. The ceiling plenum 112 may further be arranged to house light fixtures 113 to provide lighting to the room below, as well as any other fixtures and components conventionally provided within a ceiling plenum of an environmental room (e.g., particulate filters, contaminant filters, air blowers, etc.). In some cases, one or more return air wall plenums 114 are also included for directing air from the floor 104 area of the room to the ceiling plenum 112 for proper temperature and humidity control.

Figure 2C:
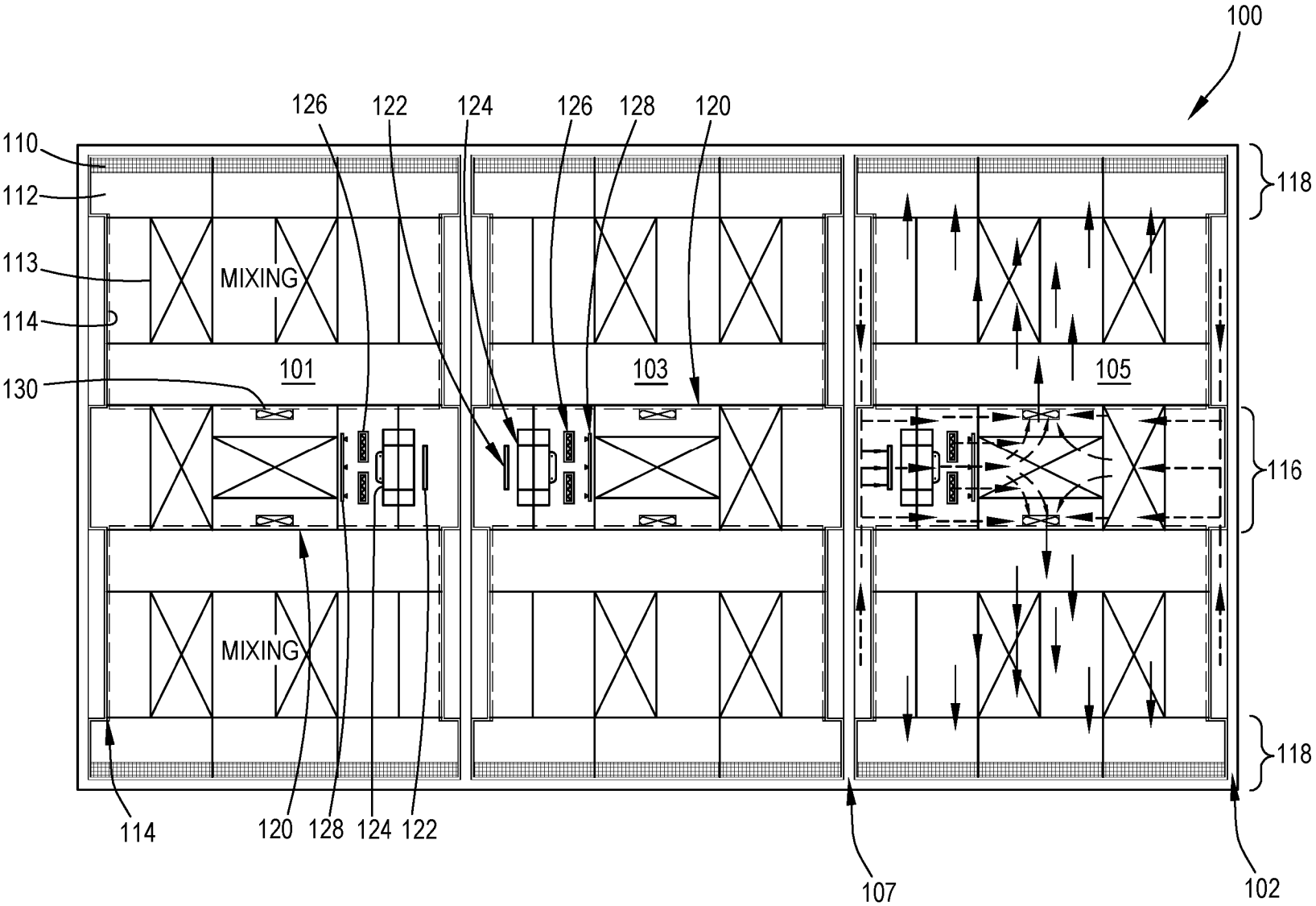
Figure 2D:
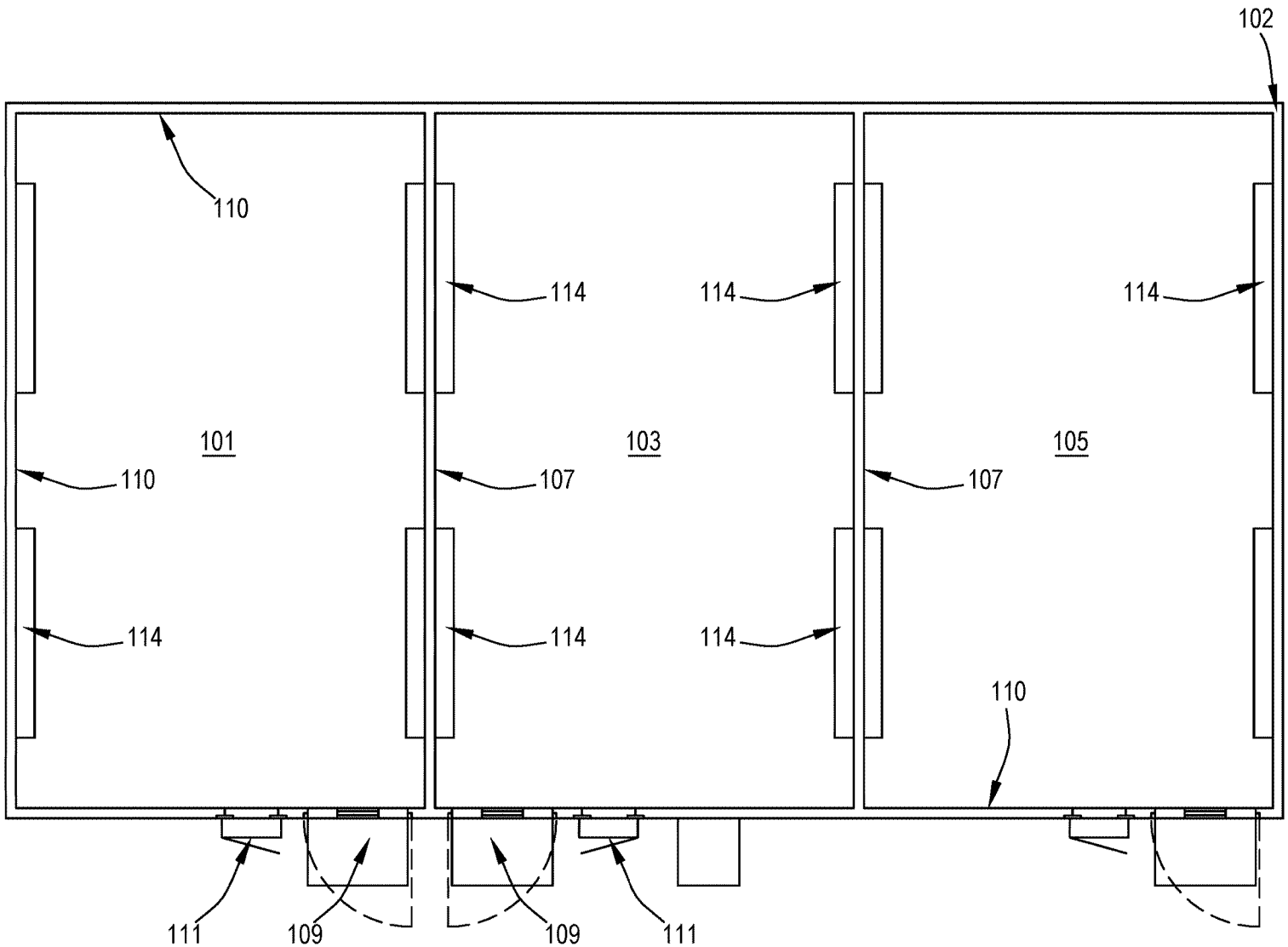

According to the present invention, as shown in FIG. 2C, the ceiling plenum 112 is divided into conditioning section(s) 116 (depicted in FIG. 2C by the bracketed central horizontally extending section) and distribution section(s) 118 (depicted in FIG. 2C by the two opposing top and bottom bracketed horizontally extending sections). According to an exemplary embodiment, a single conditioning section 116 and two opposing distribution sections 118 are located in a given ceiling plenum 112 space for each chamber 101, 103, 105. However, the present invention is not limited as such, and more than one conditioning section 116 and/or a single or more than two distribution section 118 could be provided, if desired. One or more dividers 120, in the form of baffles or the like, can be disposed within the ceiling plenum space so as to separate the conditioning section(s) 116 from the remainder of the plenum space.

As noted, the equipment necessary to "treat" air flow to provide the desired temperature and humidity specifications (i.e., air conditioning components) is disposed within the conditioning section 116. Because only a portion of the total air flow for a given chamber is passed through the air conditioning components, the equipment size can be reduced (e.g., by providing equipment with reduced capacity and/or by providing fewer numbers of a given type of equipment—e.g., two heater assemblies as opposed to four) as compared with the equipment that would be necessary in a conventional environmental room. As depicted in FIGS. 2A and 2C, the equipment will generally include a latent heat coil 122, an evaporator coil 124, heater assembly 126, and humidifier 128. The equipment may be arranged such as that depicted in FIG. 2C, so that a portion of air fed into the conditioning section 116 passes through the latent heat coil 122, evaporator coil 124, heater assembly 126, and humidifier 128 in that order. However, it is not essential that the air pass through these components in that particular order. Rather, other arrangements could be provided such that the air passes through a differing order of components. It is noted that while a single latent heat coil 122, a single evaporator coil 124, two heaters in the heater assembly 126, and a single humidifier are depicted in the exemplary embodiment shown, any number of each of these components could be included as needed to provide the require temperature and humidity specifications. In addition, while a latent heat coil 122 is provided in the depicted embodiment, this component could be any conventional relative humidity control component. For example, a latent heat coil is often used as a relative humidity control component in higher temperature conditions, while a desiccant drier is often used as a relative humidity control component in lower temperature conditions. Combinations of both types of relative humidity control components are also possible.

As such, the conditions within the chamber 101, 103, 105 can be controlled by adding and/or removing moisture and/or heating and/or cooling the portion of air flow that is circulated from the chamber 101, 103, 105 and through the air conditioning components within the conditioning section 116. The air passing through the air conditioning components can, for example, be heated by the heater assembly 126 if needed, through the control of the control unit 111 based on sensed conditions within the chamber. In addition, the air can be cooled by, for example, passing through the evaporator 124. If humidity control is needed, then a moisture input can be provided to increase humidity of air directed through the conditioning section 116, or a drying input can be provided to decrease humidity of air directed through the conditioning section 116. For example, a moisture input can include transporting a water supply into the conditioning section 116, and a drying input can include utilizing latent refrigeration coils, desiccant dehumidifiers, or transporting dry air or the like into the conditioning section 116.

Thus, an air flow is provided into the ceiling plenum 112 as shown by the downward directed and upward directed dashed arrows (this is schematically depicted in the right chamber 105 only). A portion of this air (which is not 100% of the air flow) passes through the air conditioning components within the conditioning section 116 (this air flow is depicted in FIG. 2C with the dotted arrows). After this air passes through the air conditioning components, it is referred to herein as "treated air". The remainder of the air that passes through the conditioning section 116 but that does not pass through the air conditioning components (this air flow is depicted in FIG. 2C with dashed arrows) is referred to as "untreated air". The treated air is then mixed with the untreated air, and the air mixture is then circulated into the environmental chamber below. In particular, in order to mix the treated air (dotted arrow lines) with the untreated (dashed arrow lines), one or more fans 130 are located within the ceiling plenum 112 in the air flow pathway. According to an exemplary embodiment, the one or more fans 130 are disposed within one or more dividers 120 (e.g., in the baffles) separating the conditioning section 116 from the distribution section 118. According to the present invention, the fans 130 are configured so as to take the air that passes through the air conditioning components in the conditioning section 116 and mix this treated air with the untreated air to create a homogenous mixture (depicted by solid line exiting the fans 130) that is then pumped into the room below. This homogeneous mixture of air will have the desired composition and specifications required in the environmental chamber below.

As depicted in FIG. 2C, the ceiling plenum 112 may include what is referred to as a "mixing section" (labeled only in the left chamber 101) disposed between the bracketed conditioning section 116 and each bracketed distribution section 118. This mixing space is preferably pressurized, and the homogeneous mixture (represented by the solid lines exiting the fans 130) from the conditioning section 116 can further mix as it flows towards the distribution section 118 where it is then distributed or extruded into the room/chamber below (e.g., through egg-crate type openings disposed therein as depicted by the hatched sections in this embodiment).

Because the homogeneous mixture is formed of (1) a percentage of treated air having a first set of conditions (in other words, a particular temperature and humidity as obtained through the air conditioning components/equipment) and (2) a percentage of untreated air having a second set of conditions (in other words, a temperature and humidity of circulated air that has not been treated/adjusted), the percentage of treated air vs. untreated air as well as the first set of conditions and second set of conditions are all taken into account so as to form the homogeneous mixture with the necessary room specifications. According to embodiments of the present invention, the percentage of air that is passed through the air conditioning components is about 20-50% of the total air flow. Thus, the remainder of the air (untreated air) makes up the remainder 80-50% of the total air flow. According to an exemplary embodiment of the invention, this ratio of treated air to untreated air remains constant or relatively constant, while the air conditioning components vary their output in order to provide the desired homogeneous mixture having the desired composition and specifications required in the environmental chamber below. In other words, for example, if the temperature of the homogeneous mixture needs to be reduced more, then the air conditioning components function so as to reduce the treated air temperature further. This applies equally to increases in temperature as well as increases and decreases in humidity.

By splitting up the plenum space so that only a portion of the total air flow passes through the air conditioning components for treatment, smaller and/or fewer units of equipment (e.g., evaporator and condenser units) can be used than would otherwise be required in a conventional environmental room in which the entire air flow passes through the air conditioning components/equipment. This beneficially provides lower construction costs and a reduction in energy consumption. In addition, the design of the system provides for improved uniformity of the desired environmental parameters, particularly temperature and humidity uniformity.

Figure 2E:
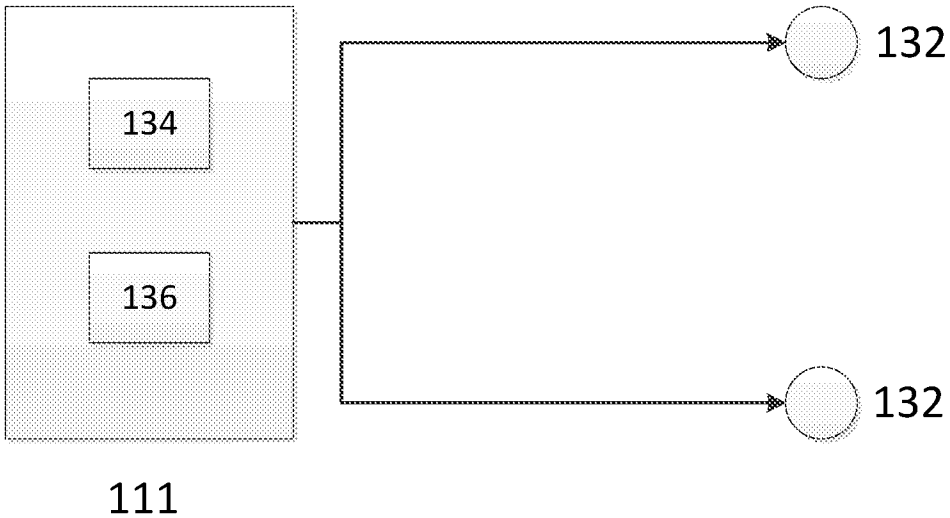
FIG. 2E is a schematic representation of a control panel in communication with temperature and humidity sensors.

FIG. 2E is a schematic representation of a control panel 111 in communication with temperature and humidity sensors 132 disposed in an environmental room chamber and in the ceiling plenum. The control panel 111 is for setting a required temperature level and a required humidity level in the environmental room chamber. The control panel 111 has a temperature control unit 134 and a relative humidity control unit 136.

Figure 2F:
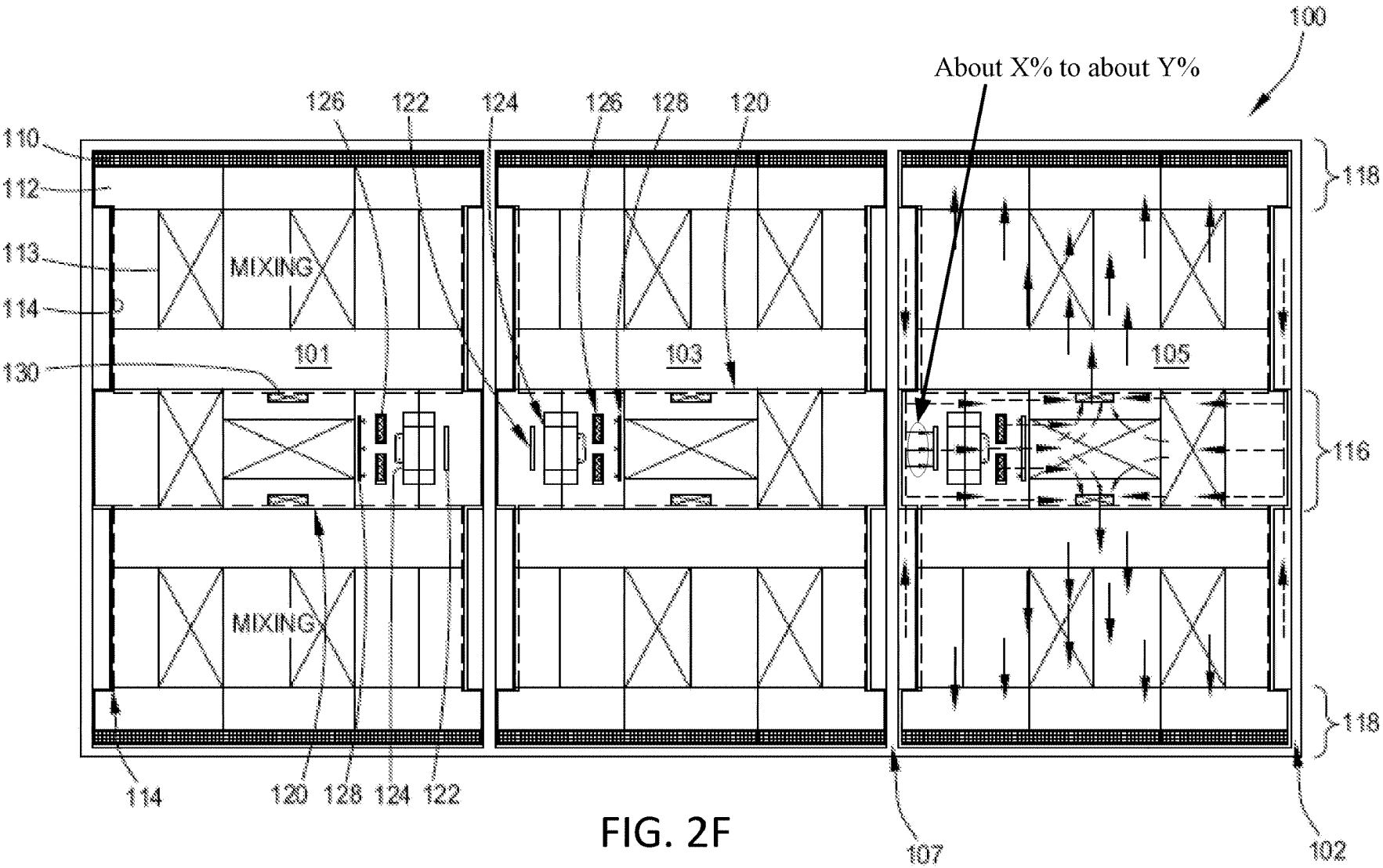
FIG. 2F is a top cross-section view within a ceiling plenum space.

FIG. 2F is a top cross-section view within a ceiling plenum space. The ceiling plenum space in FIG. 2F is similar to the ceiling plenum space in FIG. 2C. FIG. 2F, however, indicates that about X % to about Y % of the air flow from the environmental room chamber that is circulated from the environmental room chamber into the conditioning section of the ceiling plenum is directed through the air conditioning components. In an exemplary implementation, X equals 20 and Y equals 50.

It is noted that while the present detailed description refers generally to environmental rooms, the present design could beneficially be applied to any specific variety of controlled rooms such as, for example, stability rooms, warm rooms, cold rooms and test chambers.

What is claimed is:

1. An environmental room comprising:

an outer housing having a top surface, a bottom surface, and side surfaces;

a ceiling, and walls disposed within the outer housing to define an environmental room chamber;

a ceiling plenum disposed between the ceiling and the top surface of the outer housing;

an air wall plenum between a first one of the walls and a first one of the side surfaces of the outer housing, wherein the air wall plenum extends from a lower area of the environmental room chamber to the ceiling plenum and carries air from the environmental room chamber to the ceiling plenum;

a baffle, inside the ceiling plenum, wherein the baffle divides the ceiling plenum into a conditioning section and a distribution section, with an opening in the baffle;

a fan at the opening in the baffle; and air conditioning components disposed within the conditioning section, including an air conditioning evaporator that cools only a first portion of the air that was carried by the air wall plenum to the ceiling plenum, wherein a second portion of the air that was carried by the air wall plenum to the ceiling plenum flows around the air conditioning evaporator without being cooled, wherein the fan that is disposed at the opening in the baffle moves the first portion of air and the second portion of air through the opening in the baffle from the conditioning section to the distribution section, and wherein moving the first portion of air and the second portion of air from the conditioning section to the distribution section with the fan mixes the first portion of air and the second portion of air to produce an air mixture in the distribution section; and one and only one air return from the distribution section of the ceiling plenum to the environmental room chamber, wherein the one and only one air return is at an edge of the environmental room and extends along, and is parallel to, a second one of the walls of the environmental room, wherein all of the air that passes through the fan at the opening in the baffle and into the distribution section enters the environmental room chamber through the one and only one air return.

2. The environmental room of claim 1, wherein the air conditioning components comprise at least one latent heat coil and/or desiccant drier, the air conditioning evaporator, at least one heating assembly, and at least one humidifier.

3. The environmental room of claim 1, further comprising a control panel for setting a required temperature level and/or a required humidity level in the environmental room chamber, the control panel being in communication with one or more temperature and and/or humidity sensors disposed in the environmental room chamber and/or in the ceiling plenum, wherein the air conditioning components are configured to modify temperature and/or humidity of the first portion of the air that enters the conditioning section and passes through the air conditioning components, such that the mixture of treated and untreated air that is delivered from the distribution section into the environmental room chamber has the required temperature level and/or the required humidity level.

4. The environmental room of claim 1, wherein about 20% to about 50% of the air from the environmental room chamber that enters the conditioning section is directed through the air conditioning components.

5. The environmental room of claim 1, wherein the mixture of treated and untreated air delivered from the distribution section into the environmental room chamber has a temperature uniformity of ±0.3° C. or better.

6. The environmental room of claim 1, wherein the mixture of treated and untreated air delivered from the distribution section into the environmental room chamber has a humidity uniformity of ±3% or better.

7. The environmental room of claim 1, wherein the air conditioning evaporator has an evaporator fan that draws the portion of air through the evaporator.

8. The environmental room of claim 1, wherein the environmental room chamber has a required temperature level and a required humidity level and the mixture is delivered from the distribution section into the environmental room chamber at the required temperature level and required humidity level.

9. A system comprising:

an environmental room chamber, a ceiling plenum outside the environmental room chamber;

an air wall plenum outside the environmental room chamber, wherein the air wall plenum extends from a lower area of the environmental room chamber to the ceiling plenum and carries air from the environmental room chamber to the ceiling plenum;

a baffle inside the ceiling plenum, wherein the baffle divides the ceiling plenum into a conditioning section and a distribution section and defines an opening through the baffle that connects the conditioning section to the distribution section;

an air conditioning evaporator in the conditioning section of the ceiling plenum that moves coos only a first portion of the air that was carried in the air wall plenum to the ceiling plenum, wherein a second portion of the air that was carried in the air wall plenum to the ceiling plenum flows around the air conditioning evaporator without being cooled;

a fan in the opening of the baffle that moves air that has passed through the air conditioning evaporator and air that has flown around the air conditioning evaporator without being cooled from the conditioning section to the distribution section, wherein air passes, during system operation, from the conditioning section of the plenum to the distribution section of the plenum only through the opening in the baffle, wherein moving the air from the conditioning section to the distribution section with the fan mixes the air that has passed through the air conditioning evaporator with the air that has flown around the air conditioning evaporator to produce an air mixture in the distribution section to be returned to the environmental room chamber; and one and only one air return from the distribution section of the ceiling plenum to the environmental room chamber, wherein the one and only one air return is at an edge of the environmental room and extends along, and is parallel to, a second one of the walls of the environmental room, wherein all of the air that passes through the fan at the opening in the baffle and into the distribution section enters the environmental room chamber through the one and only one air return.

10. The system of claim 9, further comprising:

one or more other air conditioning components comprising a latent heat coil or a desiccant drier, a heating assembly, and a humidifier, wherein air passes, during system operation, through the latent heat coil or the desiccant drier, the heating assembly, humidifier and the air conditioning evaporator.

11. The system of claim 9, wherein the air conditioning evaporator comprises an evaporator fan that moves the air from the conditioning section through the air conditioning evaporator.

12. A system comprising:

an environmental room chamber, a first air wall plenum at a first side of the environmental room chamber;

a second air wall plenum at a second side of the environmental room chamber;

a ceiling plenum above the environmental room chamber;

wherein each of the first and second air wall plenums carries air from the environmental room chamber into the ceiling plenum;

a first baffle and a second baffle inside the ceiling plenum, wherein the first baffle and the second baffle divide the ceiling plenum into a first distribution section, a second distribution section, and a conditioning section between the first distribution section and the second distribution section;

wherein each of the first and second baffles defines an opening that connects the conditioning section to a corresponding one of the first or second distribution sections;

air conditioning components, including an air conditioning evaporator, inside the conditioning section, wherein the air conditioning evaporator cools a first portion of air that was carried by a particular one of the first or second wall plenums to the ceiling plenum, wherein a second portion of the air that was carried by the particular one of the first or second wall plenums to the ceiling plenum flows around the air conditioning evaporator and without being cooled;

a fan in an opening of each baffle, wherein each of the fans moves air that has passed through the air conditioning components and air that has flown around the air conditioning evaporator without being cooled to a corresponding one of the first or second distribution sections, wherein moving the air from the conditioning section to a corresponding one of the first or second distribution sections with each fan produces an air mixture in each of the first and second distribution sections for return to the environmental room chamber; and one and only one air return from each of the first and second distribution sections of the ceiling plenum to the environmental room chamber, wherein the one and only one air return from the first distribution section of the ceiling plenum is at a first edge of the environmental room chamber and extends along and is parallel to, one of the walls of the environmental room chamber at the first edge, wherein all of the air that passes through the fan at the opening in the first baffle and into the first distribution section enters the environmental room chamber through the one and only one air return from the first distribution section of the ceiling plenum to the environmental room chamber, and wherein the one and only one air return from the second distribution section of the ceiling plenum is at a second edge of the environmental room chamber and extends along, and is parallel to, one of the walls of the environmental room chamber at the second edge, wherein all of the air that passes through the fan at the opening in the second baffle and into the second distribution section enters the environmental room chamber through the one and only one air return from the second distribution section of the ceiling plenum to the environmental room chamber, wherein the first baffle lies in a first vertical plane and extends from the ceiling to the top surface of the outer housing and from the first side wall of the ceiling plenum to the second side wall of the ceiling plenum, wherein the first opening in the first baffle is the only opening in the first baffle, such that no air passes from the conditioning section of the ceiling plenum to the first distribution section of the ceiling plenum except through the only opening in the first baffle, wherein the second baffle lies in a second vertical plane that is parallel to the first vertical plane and wherein the second baffle extends from the ceiling to the to surface of the outer housing, and from the first side wall of the ceiling plenum to the second side wall of the ceiling plenum, wherein the second opening in the second baffle is the only opening in the second baffle, such that no air passes from the conditioning section of the ceiling plenum to the second distribution section of the ceiling plenum except through the only opening in the second baffle, wherein the first opening passes through the first baffle in a horizontal direction, wherein the second opening passes through the second baffle in a horizontal direction, wherein the one and only one air return from the first distribution section of the ceiling plenum runs along an entirety of the first edge of the environmental room chamber, wherein the one and only one air return from the first distribution section of the ceiling plenum runs along an entirety of the first edge of the environmental room chamber, and in the conditioning section:

a latent heat coil or a desiccant drier;

a heating assembly, and a humidifier, wherein air passes, during system operation, through the latent heat coil or the desiccant drier, the heating assembly, the humidifier and the air conditioning evaporator.

13. The system of claim 1, wherein the first baffle lies in a first vertical plane and extends from the ceiling to the top surface of the outer housing, and from a first surface at a first end of the ceiling plenum to a second surface at a second end of the ceiling plenum.

14. The system of claim 1, wherein the opening in the baffle is the only opening in the baffle, such that no air passes from the conditioning section of the ceiling plenum to the distribution section of the ceiling plenum except through the only opening in the first baffle.

15. The system of claim 1, wherein the opening passes through the baffle from the conditioning section to the distribution section in a horizontal direction.

16. The system of claim 1, wherein the one and only one air return from the distribution section of the ceiling plenum to the environmental room chamber runs along an entirety of an edge of the environmental room chamber.

* * * * *